United States Patent [19]

Kao

[11] Patent Number: 4,598,630

[45] Date of Patent: Jul. 8, 1986

[54] DOUBLE ACTING SELF-FLUSHING PUMP

[75] Inventor: David T. Kao, Lexington, Ky.

[73] Assignee: University of KY Research Foundation, Lexington, Ky.

[21] Appl. No.: 726,681

[22] Filed: Apr. 24, 1985

[51] Int. Cl.[4] ..... F15B 21/04; F01B 31/00

[52] U.S. Cl. ..... 92/78; 92/87; 92/129; 92/251

[58] Field of Search ..... 92/78, 87, 86.5, 129, 92/251, 61, 252

[56] References Cited

U.S. PATENT DOCUMENTS

| | | | |
|---|---|---|---|
| 2,144,662 | 1/1939 | Paasche | 92/78 |
| 2,787,126 | 4/1957 | Kleczek | 92/129 |
| 3,104,619 | 9/1963 | Swarthout | 92/87 |
| 3,146,940 | 9/1964 | McCrory et al. | 92/86.5 |
| 3,256,827 | 6/1966 | Smith | 92/86.5 |
| 3,266,435 | 8/1966 | Smith | 92/160 |
| 3,279,383 | 10/1966 | Smith | 92/87 |
| 3,818,807 | 6/1974 | Semple | 92/87 |
| 4,157,057 | 6/1979 | Bailey | 92/87 |
| 4,476,771 | 10/1984 | Kao | 92/78 |

FOREIGN PATENT DOCUMENTS

| | | | |
|---|---|---|---|
| 2853347 | 6/1980 | Fed. Rep. of Germany | 92/87 |
| 211936 | 4/1967 | Sweden | 92/251 |

*Primary Examiner*—James C. Yeung
*Attorney, Agent, or Firm*—King and Schickli

[57] ABSTRACT

A double action slurry pump is provided having a shelf-flushing piston assembly mounted in a mating cylinder. The piston assembly includes a first piston having a peripheral sealing means and a reciprocating piston rod for driving the first piston. Second and third power pistons mounted adjacent opposite sides of the first piston include sealing discs and form respective first and second chambers with the first piston and the adjacent cylinder wall. The second and third power pistons serve to pump the slurry on the sides opposite the flushing fluid chambers. Each of the pumping pistons includes hollow carriers that cooperate with shoulders fixed to the piston rod to provide limited lost motion movement. The resulting lost motion serves to vary the size of the first and second chambers. During the stroke of the piston assembly in one direction, feed lines in the piston rod provide flushing fluid to the expanding second chamber. As this occurs, the first chamber contracts and fluid is forced in a peripheral sweeping fashion from the second chamber past the sealing disc of the second piston and into the slurry. During the reverse stroke, fluid enters the expanding first chamber while being forced past the third piston from the contracting second chamber. The flushing fluid sweeping around the sealing discs of the power pistons clears the aggregate material preventing abrasive wear to the sealing disc and the cylinders.

12 Claims, 4 Drawing Figures

DOUBLE ACTING SELF-FLUSHING PUMP

TECHNICAL FIELD

The present invention relates generally to pumps and, more particularly, to a piston assembly for a double action self-flushing slurry pump.

BACKGROUND ART

In the years ahead, the use of domestic coal reserves for energy is expected to become more and more economical and popular. Such use is critical if we are to relieve our dependency on imported petroleum and other liquid/gas fuels. In the past, coal has been shipped by railway, barge and trucks. Such methods of shipping suffice for relatively small quantities of coal. However, as the use of coal increases, it becomes more and more important to provide more economic methods to transport this fuel.

For many years, petroleum and petroleum products have been transported through pipe lines over hundreds and hundreds of miles. The pipe lines are capable of transporting massive volumes of fuel to the urban centers of the country at a fraction of the cost of other transportation modes. It, therefore, is not surprising that coal slurry pipe lines for transporting coal suspended in water or other carrier liquids have been proposed. In fact, many successful slurry pipe lines are in operation today. They, however, are mostly for conveying coal over a relatively short distance to a power plant from an adjacent mine.

A major drawback of a slurry pipeline is the abrasive effect of the solid coal and rock particles on the pump. The particles tend to intrude and lodge between the pumping cylinder and the sealing lip of the piston. The lodged particles can quickly damage the flexible seals and may, under certain conditions, quickly wear the cylinder to the point where the piston no longer seals properly. This results in the loss of pumping pressure. The pump must then be rebuilt, such as by inserting a new cylinder liner and replacing the seals. This repair and replacement of the cylinder liner and seals obviously greatly increases the cost of operation of slurry pumps. Thus, solving this problem would enhance the economic feasibility of slurry pipelines.

The most successful proposal in the past includes the concept of injecting a flushing liquid behind the piston in the pump. As the piston moves forward on the power stroke, the liquid sweeps around the seals on the piston to dislodge the solid particles before damage to the seals or cylinder liner can occur. This past proposal is set forth and claimed in my prior U.S. Pat. No. 4,476,771, issued Oct. 16, 1984.

More specifically, the piston assembly in my prior device includes a first or pumping piston and a second piston coupled together in tandem. Flushing liquid is drawn into a variable volume chamber between the pistons during the suction or return stroke and ejected around the sealing periphery of the pumping piston on the slurry side during the power stroke to prevent particle intrusion of the seal. While this piston assembly structure provides greatly improved self-flushing function, I have recognized the need for even better pumping efficiency while using the same self-flushing piston assembly concept. It has occurred to me that substantial improvement can be gained if the principle of self-flushing slurry pumping could be made to be double-acting; this is with a power stroke in both directions of movement of the piston assembly.

DISCLOSURE OF THE INVENTION

Accordingly, it is a primary object of the present invention to provide a tandem piston assembly for a double action slurry pump that is self-flushing to protect the cylinder wall and piston sealing elements from the abrasive effects of the slurry particles.

Another object of the invention is to provide a double-acting piston assembly capable of receiving injected flushing liquid and by the piston movement alone sending the flushing liquid sweeping around the sealing elements to remove particulate matter.

Still another object of the present invention is to provide a piston assembly for a double action self-flushing slurry pump wherein three pistons are coupled together in tandem to provide the required action.

A further object of the present invention is to provide a three piston assembly wherein two power pistons are mounted for lost motion with respect to the third divider piston to thereby form a pair of chambers with variable volume that alternately receive flushing liquid from a supply source and eject the flushing liquid around the sealing periphery of the power pistons.

Additional objects, advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved piston assembly is provided for inducing the required particle flushing flow around the piston assembly of a double-action slurry pump. The flushing is generated by the pumping and metering action of the assembly itself. The piston assembly is mounted in a mating cylinder to form the slurry pump.

In the embodiment shown, the piston assembly includes two power pistons and a divider piston, each including corresponding peripheral sealing members. The sealing members may, of course, be fabricated of any suitable material, such as rubber or plastic, to form a wiper type seal that provides the desired sealing qualities. The divider (first) piston is positioned between and adjacent to the two power (second and third) pistons within the cylinder so as to form first and second enclosed chambers on opposite sides. Reciprocating means, such as a pump shaft, directly drive the first divider piston with the second and third power pistons being mounted through a lost motion coupling means for relative axial movement along the cylinder.

Injection means are provided for automatically providing flushing liquid into the first and second chambers during expansion thereof. As should be appreciated, the flushing liquid is injected into the first and second chambers on alternating (opposite direction) strokes of the piston assembly. Thus, as the first chamber expands and receives injected flushing liquid, the second chamber contracts. As the second chamber is being reduced in size, the high positive pressure forces the flushing liquid in the chamber past the sealed periphery of the power (third) piston into the slurry. Any particles tending to lodge or accumulate around the leading edge of the peripheral sealing member of the piston are promptly removed by the substantial liquid pressure, thus assuring against the deleterious wear of the parts. On the reverse or alternating stroke of the reciprocating means, the second chamber expands and receives injected flushing liquid while the first chamber contracts to force flushing liquid in the chamber around the sealing member of the other power (second) piston into the slurry to remove particles and reduce wear. Thus, a double acting piston assembly substantially doubling the volume output over my previous design is obtained.

In the preferred embodiment, the sealing members comprise flexible wiper discs. The divider piston includes three separate discs with the outer discs being peripherally deflected outwardly toward the power pistons. The peripherally deflected discs provide the first piston with an effective pumping structure for forcing flushing liquid from the first chamber past the two power pistons on the respective power strokes. The disks of the first piston are disposed between and fastened to a pair of mounting plates and clamped to the pump shaft. Similar flexible sealing discs of the power (second and third) pistons, respectively, are peripherally deflected away from the first piston toward the slurry. In addition, the sealing disc on the third piston includes an annular deflected inner edge adjacent the pump shaft that also seals the slurry in this area.

Each of the power pistons includes a pair of retainer plates for clamping the discs in position. The lost motion coupling means for each of the power pistons includes a hollow carrier slidably receiving the piston shaft. An annular shoulder on the shaft contacts the hollow carriers to provide the required lost motion action.

The flushing liquid injecting means includes a flushing liquid source and feed lines extending through the shaft for delivering the fluid to the first and second chambers formed between the three pistons. Check valves are provided in the feed lines and open to alternately allow delivery of the flushing fluid to the first and second chambers only during expansion thereof. The check valves close to prevent the flow of flushing fluid from the first and second chambers into the feed lines as the chambers are contracted. Additionally, pressure control is provided to permit the proper filling of the first and second chambers with flushing fluid while minimizing the drag on the pump shaft. Advantageously, this provides for minimum power being required to drive the piston assembly.

Still other objects of the present invention will become readily apparent to those skilled in this art from the following description, wherein there is shown and described in more detail the preferred embodiment of this invention. As it will be realized, the invention is capable of other different embodiments, and its several details are capable of modifications in various, obvious aspects all without departing from the invention. Accordingly, the drawing and descriptions will be regarded as illustrative in nature and not as restrictive.

BRIEF DESCRIPTION OF THE DRAWING

The accompanying drawing incorporated in and forming a part of the specification illustrates several aspects of the present invention and together with the description serves to explain the operating cycle and principals of the invention. In the drawing.

Reference will now be made in detail to the present preferred embodiment of the invention, an example of which is illustrated in the accompanying drawing.

DETAILED DESCRIPTION OF THE INVENTION

Figure 1:
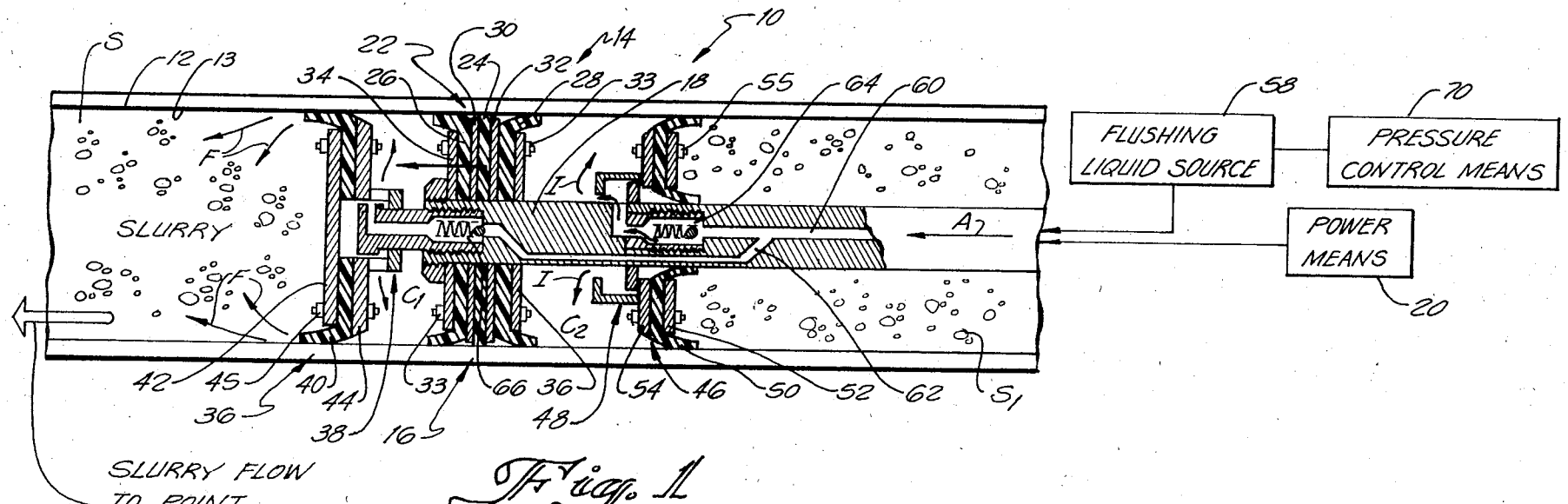
FIG. 1 is a detailed, cross-sectional view of the piston assembly mounted in a cylinder and moving to the left for pumping slurry and to simultaneously provide flushing liquid between the power piston and cylinder wall.

Reference is now made to FIG. 1, illustrating a double action self-flushing slurry pump 10 designed to utilize the improved piston assembly of the present invention. The pump 10 is designed to receive slurry from a source and transfer the slurry through lines to a suitable receiver, as is shown in my prior U.S. Pat. No. 4,476,771, which is incorporated herein by reference. Subsequent operations may, of course, then be performed after the slurry reaches the point of use, such as dewatering and burning as a fuel. Although the present invention is being described for handling coal slurry, it is clear that other types of aggregate suspended in a liquid can be pumped efficiently with this system.

The pump 10 includes a cylinder 12. Inside the cylinder 12 is a piston assembly, generally designated by reference numeral 14, constructed in accordance with the present invention to be self-flushing and, thus, prevent wear of the cylinder wall 13 and the seals as set forth in more detail below.

A first or divider piston 16 is mounted securely to a piston shaft or rod 18 and directly driven by a reciprocating power means 20. The piston 16 includes peripheral sealing means 22, preferably formed from three separate discs 24, 26 and 28. The first disc 24 is flexible and disposed between mounting plates 30 and 32 that are rigidly connected to the shaft 18. The second and third sealing discs 26 and 28 are also flexible. The second sealing disc 26 is disposed between a retaining plate 34 and the mounting plate 30. Similarly, the third disc 28 is disposed between a retaining plate 36 and the mounting plate 32. Fastening means, such as bolts and nuts 33, are used to secure the retaining plates 34, 36 to the mounting plates 30, 32 and thereby clamp the flexible discs 24, 26 and 28 to the shaft 18.

As shown, the second and third discs 26 and 28 are peripherally deflected away from the first disc 24 so as to extend around the outer peripheral edge of the associated retaining plates 32, 34 respectively. In this manner, the piston 16 has an effective wiper type seal for dividing the internal chamber and pumping flushing liquid in opposite directions on alternate strokes of the reciprocating power means 20.

A second or power piston 36 is mounted to the shaft 18 adjacent the first piston 16 by means of a coupling 38. The coupling 38 provides for limited lost motion of the second piston 36, relative to the first piston 16. This lost motion or action is important to the broader aspects of the present invention since it provides for varying the volume of a first chamber $C_1$ formed between the first and second pistons 16, 36 respectively. The varying of the volume of the chamber $C_1$ results in positive controlled movement of the flushing liquid in the desired manner to prevent wear of the cylinder and seals.

A sealing disc 40 is mounted to the second piston 36 by means of a pair of retaining plates 42, 44, connected together by a fastening means 45. The peripheral edge of the disc 40 adjacent the cylinder wall 13 is deflected away from the first piston 16 toward the slurry. Thus, the second piston 36 and the sealing disc 40 together provide an effective pumping element for pumping the slurry on the left side of the assembly 14, as shown in the Figure.

A third or power piston 46 is mounted to the shaft 18 adjacent a second side of the first piston 16 by means of a coupling 48. Like the coupling 38, the coupling 48 provides for limited lost motion of the third piston 46 relative to the first piston 16. Thus, a second chamber $C_2$ formed between the first and third pistons 16, 46 respectively, is also of variable volume and functions to provide flushing liquid between the third piston and the cylinder wall 13 so as to reduce component wear.

The third piston 46 also includes a sealing means, such as a flexible disc 50. The sealing disc 50 is mounted to the third piston 46 by means of a pair of retaining plates 52, 54 connected together by fastening means 55, with the disc disposed therebetween. The disc 50 includes an outer peripheral edge adjacent the cylinder wall 13 and an annular inner portion or edge 56 received about the shaft 18 that are both deflected away from the first piston 16 toward the slurry.

Thus, it should be appreciated that the piston assembly 14 includes an effective structure for pumping slurry during each back and forth stroke of the reciprocating means 20 to effectively double the pumping output.

Means are provided for injecting flushing liquid into the first chamber $C_1$, formed between the first and second pistons 16, 36, and the second chamber $C_2$, formed between the first and third pistons 16, 46. The means may include a flushing liquid source 58, such as a tank of water and a pump (not shown) or other means of delivering flushing liquid. As shown, feed lines 60, 62 extend through the shaft 18 from the source to deliver flushing liquid to the second and first chambers $C_2$, $C_1$, respectively. Check valves 64, 66 are provided, one in each of the lines 60, 62, respectively. Check valve 64 opens and allows delivery of flushing liquid to the second chamber $C_2$ (see FIG. 1) during expansion. Conversely, check valve 66 remains closed to prevent retroflow of flushing liquid from the first chamber $C_1$ into the feed line 62 during contraction of the chamber $C_1$.

Check valve 66 operates in a similar manner with respect to the first chamber $C_1$. During the expansion of the chamber $C_1$, the check valve 66 opens to allow the delivery of flushing liquid into the chamber (see FIG. 3). Conversely, during contraction of the second chamber $C_2$, check valve 64 closes to prevent the flow of flushing liquid from the second chamber into the feed line 60. Of course, pressure control means 70 as discussed in detail in my previously issued U.S. Pat. No. 4,476,771 may also be provided to permit proper filling of the first and second chambers with the flushing liquid while minimizing drag on the pump shaft 18.

As shown in FIG. 1, in operation the pump shaft 18 moves in the direction of arrow A. As this occurs, the volume of the first chamber $C_1$ formed between the first and second pistons 16 and 36, respectively, is being reduced while the volume of the second chamber $C_2$ formed between the first and third pistons 16 and 46, respectively, is being increased. This is due to the lost motion movement of the second and third pistons 36, 46 relative to the first piston 16. As a consequence, flushing liquid in the first chamber $C_1$ is being subjected to increased pressure as the volume of that chamber is reduced. In addition to the flushing liquid in the chamber $C_1$ being prevented from entering the feed line 62 as the pressure serves to close the check valve 66, the flushing liquid is prevented from moving into the second chamber $C_2$ past the first piston 16 by the sealing disc 26. This results in the flushing liquid being forced in the direction of action arrows F (in FIG. 1) around the periphery of sealing disc 40 of second piston 36 and into the slurry S. As this occurs, any trapped aggregate material is advantageously removed from the seal area. Since the particles are removed from the seal area, they cannot lodge at the interface between the seal member 40 and the cylinder wall 13 and, therefore deleterious wear of both components is prevented. Of course, as all this occurs, it should be recognized that the second chamber $C_2$ is expanding with the check valve 64 open for the delivery of flushing liquid from the feed line 60 into the second chamber (note action arrows I in FIG. 1).

Figure 2:
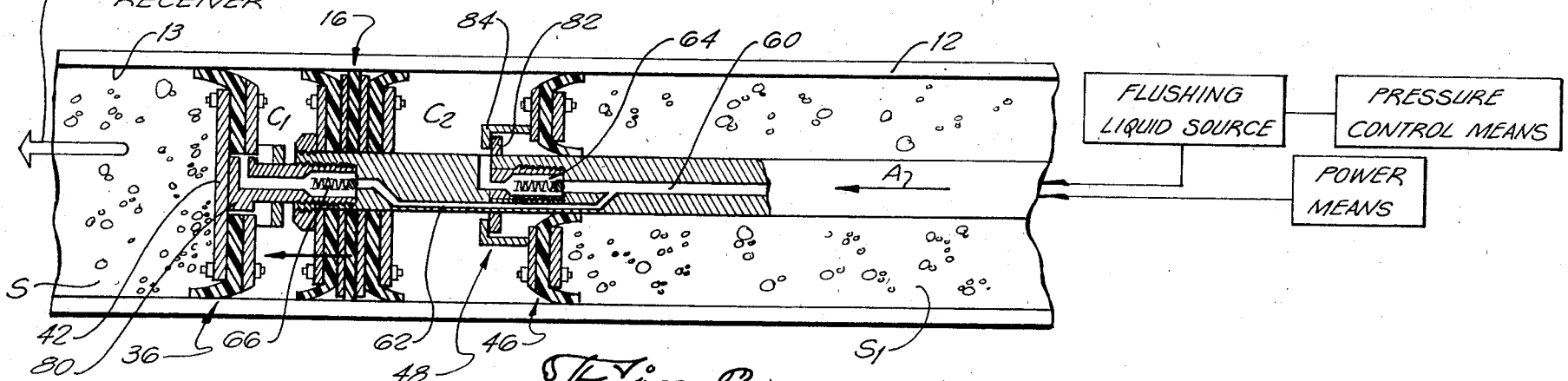
FIG. 2 is a view similar to FIG. 1 but with the piston assembly extended completely to the left following the pumping of the slurry.

As shown in FIG. 2, continued movement of the shaft 18 in the direction of arrow A finally causes shoulder 80 on the end of the shaft 18 to bottom out in the coupling 38. At the same time, the second shoulder 82 on the shaft 18 engages the hollow carrier 84 of the coupling 48. Thus, movement of the first, second and third pistons 16, 36, 46 is completed; the second piston 36 having pumped slurry along the left hand side of the cylinder 12 and piston 46 having sucked flushing liquid through the open check valve 64 into the second chamber $C_2$. The check valve 64 closes and the piston assembly 14 is ready for the return stroke.

Figure 3:
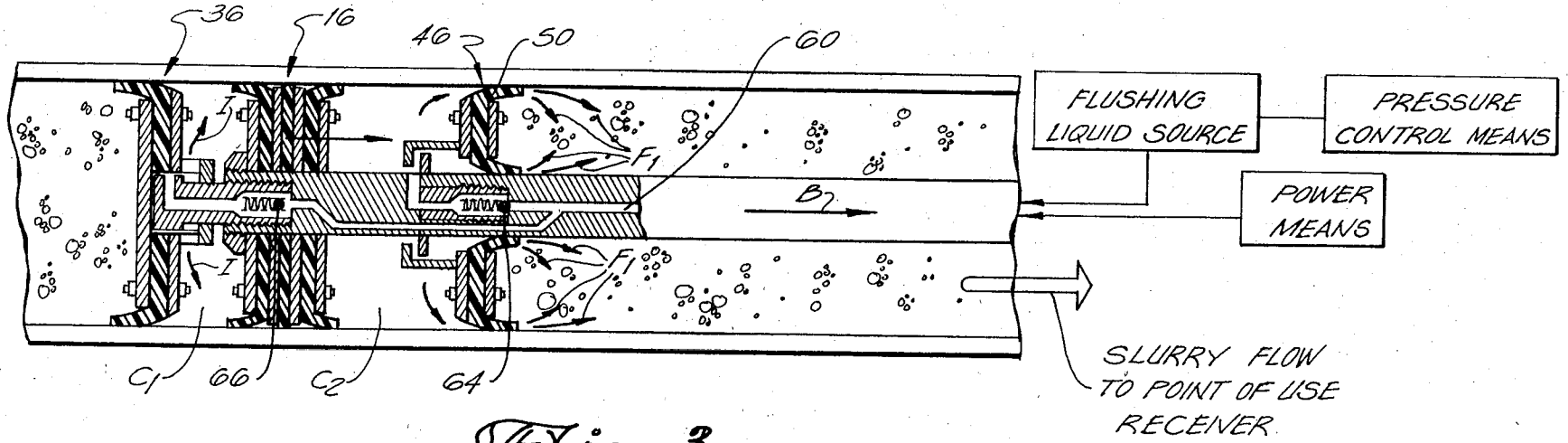
FIG. 3 is another detailed cross-sectional view showing the piston assembly moving to the right on the return stroke to pump slurry and to simultaneously provide an injection of flushing liquid past the other power piston.

As shown in FIG. 3, on the return stroke in the direction of arrow B, lost motion of the second and third pistons 36, 46 relative to the first piston 16 is again provided. The volume of the first chamber $C_1$ between the first and second pistons 16, 36 increases. With the expanding volume, flushing liquid is delivered to the first chamber $C_1$ through the open check valve 66 from the line 62 (note action arrows I). Simultaneously, the volume of the second chamber $C_2$ between the first and third pistons 16 and 46 decreases and pressure in the chamber increases. With the check valve 64 closed the prevent flushing liquid in the chamber $C_2$ from entering the feed line 60, and the first piston 16 preventing transfer into the first chamber $C_1$, the flushing liquid in the second chamber $C_2$ is expelled to sweep around the inner and outer periphery of the sealing disc 50 (see flow arrows $F_1$ in FIG. 3). Again, as this occurs, particles are removed from the seal area along the cylinder walls and pump shaft 18 and wear due to abrasion from the aggregate particles is prevented.

Figure 4:
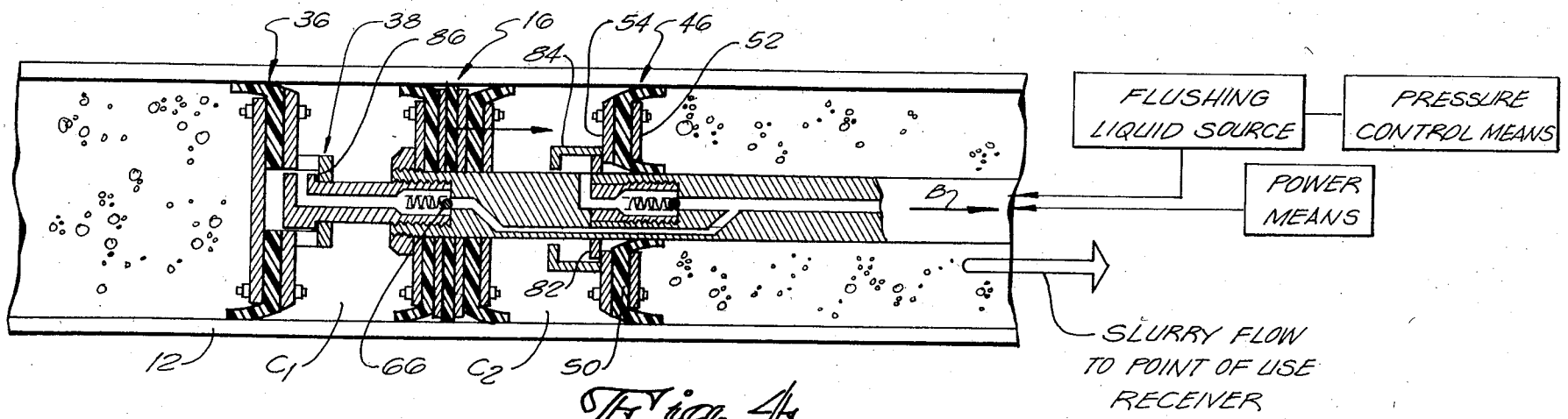
FIG. 4 is a view similar to FIG. 3 but with the piston assembly extended completely to the right following the pumping of slurry.

Continued movement of the shaft 18 in the direction of arrow B, as shown in FIG. 4, results in the shoulder 80 on the end of the shaft 18 contacting and engaging the inner end of hollow carrier 86 of coupling 38, and the shoulder 82 on the shaft 18 bottoming out on the retainer plate 54 in the coupling 48. In this manner, the slurry is pumped to the right, as shown in FIG. 4 by the third piston 46. At the same time, the chamber $C_1$ is now filled with flushing liquid and the check valve 66 closes. The slurry at the right hand end of the cylinder 12 in thus pumped (see slurry flow arrows in FIGS. 3 and 4). As will be realized, the two ends of the cylinder 12 may be interconnected (not shown) to feed into a single point of use receiver. Once the piston assembly 14 comes to a stop in the FIG. 4 location, the cycle is ready to repeat itself.

In summary, the piston assembly 14 of the present invention provides double pumping action with a self-cleaning feature. The assembly includes a first piston 16 mounted for movement with the pump shaft 18 between two power pistons 36, 46 mounted to the same shaft for lost motion movement. Relative movement between the first and second pistons and first and third pistons is, thus, allowed, so as to create two chambers $C_1$, $C_2$ of variable volume therebetween. Flushing liquid fills each chamber as it expands. The flushing liquid is then forced from each chamber as it contracts during pumping, advantageously sweeping around the peripery of sealing members 40 and 50 and thereby removing particles and aggregate material in the seal area. Thus, wear to the seal and cylinder wall is minimized and pumping efficiency is improved by providing slurry pumping action during each stroke of the shaft.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and the variations are within the scope of the invention as determined by the appended claims when interpreted in accordance with the breadth to which they are fairly, legally and equitably entitled.

I claim:

1. A piston assembly for mounting in a mating cylinder to form a pump for slurry or the like, comprising:

a first piston, including a first peripheral sealing means;

a reciprocating means for driving said first piston within the cylinder;

a second piston, including a second peripheral sealing means, said second piston being adjacent one side of said first piston, said second piston forming a first enclosed chamber with said first piston and said cylinder;

a third piston, including a third peripheral sealing means, said third piston being adjacent an opposite side of said first piston, said third piston forming a second enclosed chamber with said first piston and said cylinder;

means for coupling said second and third pistons to said reciprocating means to provide lost motion and vary the size of the first and second chambers;

means for injecting flushing liquid into said first chamber during expansion thereof and into said second chamber during expansion thereof;

whereby on alternating strokes of the piston assembly flushing liquid is forced alternately past the second piston by contraction of said first chamber and past the third piston by contraction of said second chamber, said flushing liquid removing slurry particles around said second and third pistons to reduce wear during pumping operation.

2. The piston assembly set forth in claim 1, wherein said first sealing means includes three sealing discs.

3. The piston assembly set forth in claim 2, wherein said first piston includes a pair of mounting plates rigidly attached to said reciprocating means and a first pair of retaining plates, one of said sealing discs being disposed between said mounting plates, another of said sealing discs being disposed between one of said retaining plates and one of said mounting plates on the side of said first piston and another sealing disc being disposed between the other of said retaining plates and the other of said mounting plates on other side of said first piston.

4. The piston assembly set forth in claim 3, wherein said sealing discs are flexible, one sealing disc being peripherally deflected toward said second piston and another sealing disc being peripherally deflected toward said third piston.

5. The piston assembly set forth in claim 1, wherein said second and third sealing means are flexible discs peripherally deflected away from said first piston toward the slurry.

6. The piston assembly disclosed in claim 5, wherein said reciprocating means is a shaft extending through said third piston and said third flexible disc includes an annular inner portion received about said shaft and deflected toward the slurry.

7. The piston assembly disclosed in claim 1, wherein said injecting means includes a flushing liquid source and flushing liquid delivery means.

8. The piston assembly disclosed in claim 7, wherein said delivery means includes flushing liquid feed lines extending through said reciprocating means for delivering fluid to said first and second chambers.

9. The piston assembly disclosed in claim 8, wherein check valve means are provided in said feed lines, said check valve means opening to alternately allow delivery of said flushing fluid to said first and second chambers only during expansion thereof and alternately closing to prevent flow of flushing fluid from said first and second chambers into said feed lines during contraction thereof.

10. The piston assembly disclosed in claim 1, wherein pressure control means is provided to permit the proper filling of said first and second chambers with flushing fluid while minimizing the drag on said reciprocating means.

11. The piston assembly disclosed in claim 1, wherein said coupling means includes a hollow carrier for said second piston slidably receiving the end of said shaft and a shoulder on the end of said shaft for limited reciprocating movement within said first carrier to provide the lost motion.

12. The piston assembly disclosed in claim 11, wherein said coupling means also includes a hollow carrier for said third piston slidably receiving said shaft and a shoulder on said shaft for limited reciprocating movement within said carrier to provide lost motion.

* * * * *